US010147380B2

(12) United States Patent
Wu et al.

(10) Patent No.: US 10,147,380 B2
(45) Date of Patent: Dec. 4, 2018

(54) SOURCE DRIVING MODULE AND LIQUID CRYSTAL DISPLAY PANEL

(71) Applicant: Shenzhen China Star Optoelectronics Technology Co., Ltd., Shenzhen, Guangdong (CN)

(72) Inventors: Jingjing Wu, Guangdong (CN); Zhi Xiong, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 129 days.

(21) Appl. No.: 14/770,140

(22) PCT Filed: Jul. 17, 2015

(86) PCT No.: PCT/CN2015/084377
§ 371 (c)(1),
(2) Date: Feb. 6, 2017

(87) PCT Pub. No.: WO2017/004850
PCT Pub. Date: Jan. 12, 2017

(65) Prior Publication Data

US 2017/0206849 A1 Jul. 20, 2017

(30) Foreign Application Priority Data

Jul. 6, 2015 (CN) ..... 2015 1 0392243

(51) Int. Cl.
*G09G 5/00* (2006.01)
*G09G 3/36* (2006.01)

(52) U.S. Cl.
CPC ..... *G09G 3/3688* (2013.01); *G09G 3/3648* (2013.01); *G09G 3/3685* (2013.01);
(Continued)

(58) Field of Classification Search
CPC .. G09G 3/3648; G09G 3/3688; G09G 3/3685; G09G 3/36; G09G 2310/0289; G09G 2310/08; G09G 2310/027
See application file for complete search history.

(56) References Cited

U.S. PATENT DOCUMENTS 6,424,328 B1 7/2002 Ino
7,728,832 B2 * 6/2010 Okamura ..... G09G 3/3666 345/204
(Continued)

FOREIGN PATENT DOCUMENTS

CN 1428757 A 7/2003
CN 1941058 A 4/2007
(Continued)

OTHER PUBLICATIONS

20151212US_ISR, CN, China Patent Office.

*Primary Examiner* — Vijay Shankar
(74) *Attorney, Agent, or Firm* — Andrew C. Cheng

(57) ABSTRACT

A source driving module includes: n data input channels, receiving n data signals from the timing controller; n level shifters, coupled to the n data input channels; n digital to analog converters, coupled to the n level shifters; N switches, divided into $$\frac{N}{n}$$

switch groups, each switch group coupled to the n digital to analog converters; N buffers, divided into $$\frac{N}{n}$$

(Continued)

buffer groups, each buffer group coupled to one of the $$\frac{N}{n}$$

switch groups; a frequency divider, for converting clock signal into switch controlling signal to alternatively switch on the $$\frac{N}{n}$$

switch groups. During a mth period of data transmission, the n data input channels receive data signals of n pixels from the timing controller, and the data signals of n pixels is fed to a mth buffer group via a mth switch group upon receiving the switch controlling signal. The present invention also proposes an LCD panel using the source driving module.

12 Claims, 2 Drawing Sheets

(52) U.S. Cl.
CPC ..... *G09G 2310/027* (2013.01); *G09G 2310/0289* (2013.01); *G09G 2310/08* (2013.01)

(56) References Cited

U.S. PATENT DOCUMENTS

| | | | | |
|---|---|---|---|---|
| 8,614,702 | B2 * | 12/2013 | Okamura | G09G 3/3666 345/204 |
| 2008/0192031 | A1 * | 8/2008 | An | G09G 3/2096 345/204 |
| 2012/0206506 | A1 * | 8/2012 | Kim | G09G 3/20 345/690 |

FOREIGN PATENT DOCUMENTS

| | | | |
|---|---|---|---|
| CN | 101295475 | A | 10/2008 |
| CN | 101577107 | A | 11/2009 |
| CN | 102637417 | A | 8/2012 |

* cited by examiner

SOURCE DRIVING MODULE AND LIQUID CRYSTAL DISPLAY PANEL

BACKGROUND OF THE INVENTION

1. Field of the Invention

The present invention relates to the field of liquid crystal display technology, and more particularly, to a source driving module and a liquid crystal display (LCD) panel having the source driving module.

2. Description of the Prior Art

A liquid crystal display (LCD) has such merits of thinness, lightness, power saving, and low radiation as to be applied in notebook computers, mobile phones, electronic dictionaries and other electronic display devices. As per the LCD technology having been developing, so changes the environment in which the electronic display devices are used. They are more often used outdoors. Demand on visual effects is rising, so a LCD device of greater lightness is expected. The LCD panel is a main component of the LCD. The LCD panel includes a color filter substrate, a thin film transistor (TFT) array substrate and a liquid crystal layer therebetween.

The LCD panel is driven by a gate driving module and a source driving module for supplying scan signals and data signals to pixels. Various voltage drops between the data signal and a common voltage induces liquid crystals rotating in different angles to show different brightness, so that the LCD panel shows various grey levels. As shown in FIG. 1, a conventional source driving module includes bi-directional shift registers S/R, latches L, level shifters L/S, digital to analog converters DAC, and buffers B. Digital signals from a timing controller (TCOM) are fed to the latches L via bi-directional shift registers S/R. The level shifters L/S boost voltages of the digital signals, and then the digital to analog converters DAC convert the digital signal into analog signals and transmit to the buffers B. The buffers B output the analog signals to the pixels. As shown in FIG. 1, when there are N pixels arranged in a row, the source driving module supplies N signals to the N pixels. Therefore, the source driving module requires N bi-directional shift registers $S/R_1$~$S/R_N$, N latches $L_1$~$L_N$, N level shifters $L/S_1$~$L/N_N$, N digital to analog converters $DAC_1$~$DAC_N$, and N buffers $B_1$~$B_N$. Each data input channel has a bi-directional shift register S/R, a latch L, a level shifter L/S, a digital to analog converter DAC, and a buffer B. In other words, there are many pixels in a row, i.e. N is a great integer. The conventional source driving module includes more elements and high cost.

SUMMARY OF THE INVENTION

In view of the deficiency of the conventional technology, the present invention provides a source driving module of which each sub-module comprises less elements, thereby reducing costs.

According to the present invention, a source driving module for supplying data signals sent from a timing controller to a plurality of subpixels of a liquid crystal display panel is provided. N subpixels are arranged in a row. The source driving module comprises: n data input channels, receiving n data signals from the timing controller; n level shifters, coupled to the n data input channels; n digital to analog converters, coupled to the n level shifters; N switches, divided into $$\frac{N}{n}$$

switch groups, each switch group coupled to the n digital to analog converters; N buffers, divided into $$\frac{N}{n}$$

buffer groups, each buffer group coupled to one of the $$\frac{N}{n}$$

switch groups; a frequency divider, for converting a clock signal sent from the timing controller into a switch controlling signal to alternatively switch on the $$\frac{N}{n}$$

switch groups. During a mth period of data transmission, the n data, input channels receive data signals of n pixels from the timing controller, and the data signals of n pixels is fed to a mth buffer group via a mth switch group upon receiving the switch controlling signal, where N is an integer greater than 1, n is an even number, N>>n, $$\frac{N}{n}$$

is an integer greater than 1, and m=1, 2, 3, . . . , $$\frac{N}{n}.$$

When receiving the data signals, the N buffers are controlled to transmit the data signals to the N subpixels by the timing controller.

In one aspect of the present invention, $2 \leq n \leq 10$.

In another aspect of the present invention, n=6.

In another aspect of the present invention, a period of data transmission and is several times of a duty cycle of the clock signal, and a duty cycle of the switching controlling signal equals to the period of data transmission, the period of data transmission indicates a period which each data input channel receive data signal of a pixel from the timing controller.

In still another aspect of the present invention, each data input channel receive a 8-bit digital data signal during the period of data transmission.

In yet another aspect of the present invention, the period of data transmission comprises four duty cycles of the clock signal.

According to the present invention, a liquid crystal display (LCD) panel comprises a display unit comprising a plurality of subpixels, a timing controller, a gate driving module controlled by the timing controller to supply scan signal to the plurality of subpixels, and a source driving module controlled by the timing controller to supply data signal to the plurality of subpixels. The source driving module comprises elements as suggested above.

In contrast to prior art, the present invention provides a source driving module of which each sub-module comprises less elements, thereby reducing costs.

DETAILED DESCRIPTION OF THE PREFERRED EMBODIMENTS

Figure 1:
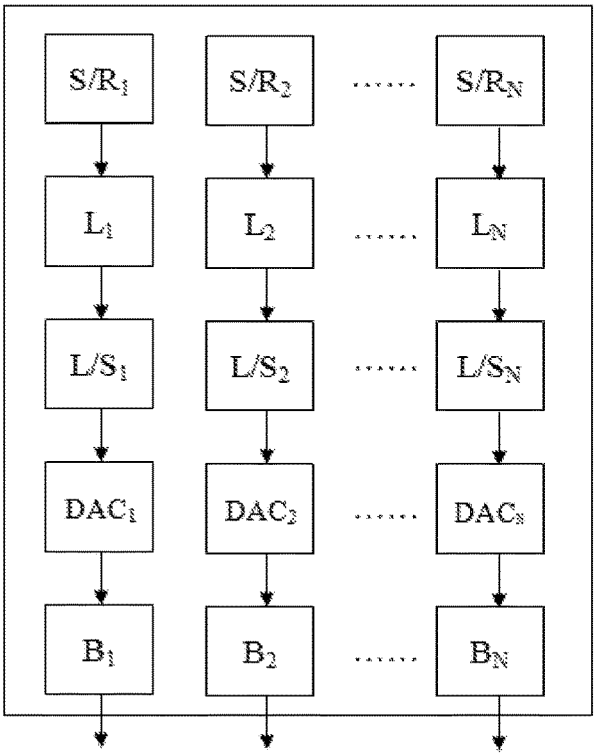
Fig. 1 (Prior art)
FIG. 1 is a schematic diagram of a conventional source driving module.

Although the present invention has been explained by the embodiments shown in the drawings described above, it should be understood to the ordinary skilled person in the art that the invention is not limited to the embodiments, but rather various changes or modifications thereof are possible without departing from the spirit of the invention. Accordingly, the scope of the invention shall be determined only by the appended claims and their equivalents.

Figure 2:
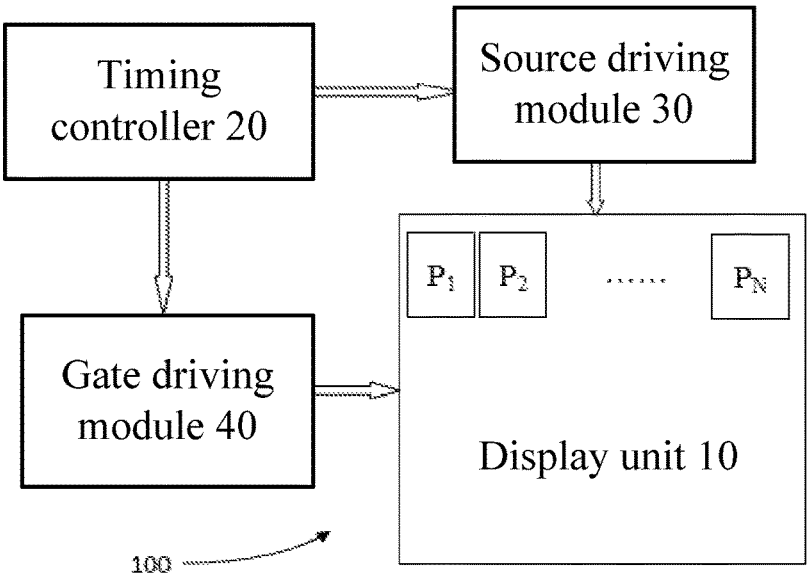
FIG. 2 is a block diagram of a source driving module according to a preferred embodiment of the present invention.

Referring to FIG. 2, a liquid crystal display (LCD) panel 100 comprises a display unit 10, a timing controller 20, a source driving module 30, and a gate driving module 40. The display unit 10 comprises a plurality of subpixels P. There are N subpixels $P_1$, $P_2$, . . . , $P_N$ in a row. The timing controller 20 controls the source driving module 30 to supply data signal to the subpixel P and controls the gate driving module 40 to supply scan signal to the subpixel P.

Figure 3:
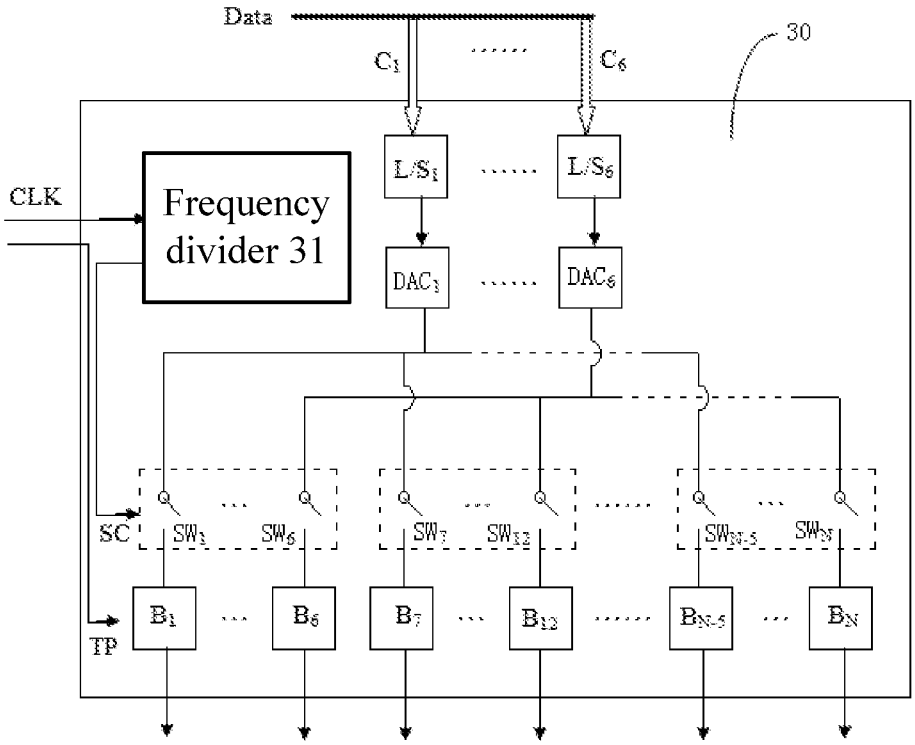
FIG. 3 is a schematic diagram of a source driving module according to a preferred embodiment of the present invention.

Referring to FIG. 3, according to the preferred embodiment of the present invention, the source driving module 30 comprises n data input channels, n level shifters, n digital to analog converters (DACs), N switches (divided into $$\frac{N}{n}$$

groups), N buffers (divided into $$\frac{N}{n}$$

groups), and a frequency divider, where N is an integer greater than 1, n is an even number, N>>n, and $$\frac{N}{n}$$

is an integer greater than 1. N depends on the number of subpixels in a row of the display unit 10, e.g. 960 or 1024. Because N is much greater than n, n is preferred selected from $2 \le n \le 10$.

In this embodiment, n=6 is selected as an example.

As shown in FIG. 3, the source driving module 30 comprises six data input channels $C_1$~$C_6$, six level shifters $L/S_1$~$L/S_6$, six digital to analog converters $DAC_1$~$DAC_6$, N switches $SW_1$~$SW_N$, N buffers $B_1$~$B_N$, and a frequency divider 31.

The six data input channels $C_1$~$C_6$ receive six data signals Data from the timing controller 20. The data signals Data is digital signal.

The six level shifters $L/S_1$~$L/S_6$ are respectively connected to the six data input channels and are used for boosting voltages of the digital data signals Data.

The six digital to analog converters $DAC_1$~$DAC_6$ are respectively connected to the six level shifters $L/S_1$~$L/S_6$, and are used for converting the digital data signals Data into analog signal.

N switches $SW_1$~$SW_N$ are divided into $$\frac{N}{6}$$

switch groups, each group comprises six switches respectively connected to the six digital to analog converters $DAC_1$~$DAC_6$. Specifically, the first switch group has six switches $SW_1$~$SW_6$ respectively connected to the six digital to analog converters $DAC_1$~$DAC_6$. The second switch group has six switches $SW_7$~$SW_{12}$ respectively connected to the six digital to analog converters $DAC_1$~$DAC_6$. Similarly the $$\left(\frac{N}{6}\right)th$$

switch group has six switches $SW_{N-5}$~$SW_N$ respectively connected to the six digital to analog converters $DAC_1$~$DAC_6$.

The N buffers $B_1$~$B_N$ respectively connected to the N switches $SW_1$~$SW_N$. In another aspect, the N buffers $B^1$~$B_N$ are divided into $$\frac{N}{6}$$

buffer groups. Specifically, the first buffer group has six buffers $B_1$~$B_6$ respectively connected to the six switches $SW_1$~$SW_6$. The second buffer group has six buffers $B_7$~$B_{12}$ respectively connected to the six switches $SW_7$~$SW_{12}$. Similarly the $$\left(\frac{N}{6}\right)th$$

buffer group has six buffer $B_{N-5}$~$B_N$ respectively connected to the six switches $SW_{N-5}$~$SW_N$.

Figure 4:
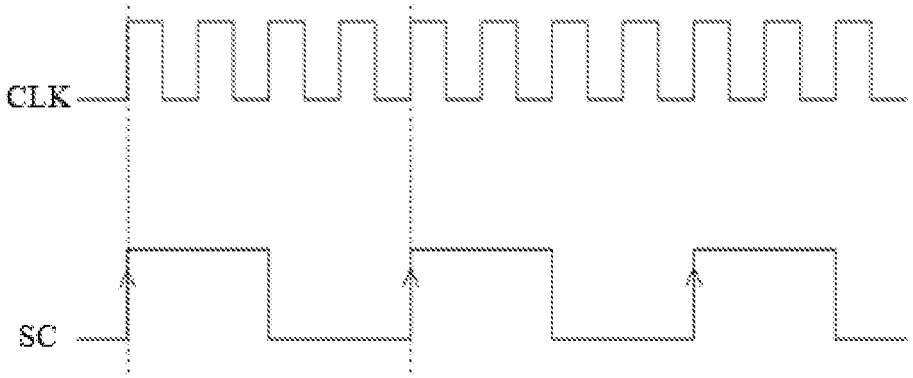
FIG. 4 is a timing diagram of a switch controlling signal and a clock signal according to a preferred embodiment of the present invention.

The frequency divider 31 converts a clock signal CLK sent from the timing controller 20 into a switch controlling signal SC, for alternatively switching on the $$\frac{N}{6}$$

switch groups. A duty cycle of the switching controlling signal SC equals to a period of data transmission and is several times of a duty cycle of the clock signal CLK. The period of data transmission indicates a period which all the six data input channels $C_1$~$C_6$ receive digital data signal of a pixel from the timing controller 20. For instance, the timing controller 20 outputs a 8-bit digital data signal of a pixel. Since the six data input channels $C_1$~$C_6$ receive the 8-bit digital data signal in four duty cycles of the clock signal CLK, the period of data transmission is four duty cycles of the clock signal CLK. Accordingly, the duty cycle of the switch controlling signal also equals to four duty cycles of the clock signal CLK, as shown in FIG. 4.

Processes relating to the source driving module 30 transmitting the data signal are introduced as follows: during the mth period of data transmission, the six data input channels $C_1$~$C_6$ receive data signals of six pixels from the timing controller 20, switches of the mth switch group are all turned on upon receiving the switch controlling signal SC, while switches of the other switch groups are turned off, where m=1, 2, 3, . . . , $$\frac{N}{n}.$$

The data signals of the six pixels are transmitted to the mth buffer group through the turned on switches of the mth switch group. After the N buffers $B_1$~$B_N$ receive the data signals, i.e. the data signals of subpixels $P_1$~$P_N$ in a row, the timing controller 20 transmits holding signal TP to the buffers $B_1$~$B_N$, so as to control the buffers $B_1$~$B_N$ conducting the digital signals to the subpixels $P_1$~$P_N$.

Specifically, during a first period of data transmission, the switches $SW_1$~$SW_6$ turn on while the other switches turn off in the first cycle of the switch controlling signal SC. At this moment, six data signals which are sent from the timing controller 20 and received by the data input channels $C_1$~$C_6$ are fed to the buffers $B_1$~$B_6$ through the switches $SW_1$~$SW_6$. During a second period of data transmission, the switches $SW_7$~$SW_{12}$ turn on while the other switches turn off in the second cycle of the switch controlling signal SC. At this moment, six data signals which are sent from the timing controller 20 and received by the data input channels $C_1$~$C_6$ are fed to the buffers $B_7$~$B_{12}$ through the switches $SW_7$~$SW_{12}$. Similarly, during a $$\left(\frac{N}{6}\right)th$$

period of data transmission, the switches $SW_{N-5}$~$SW_N$ of the $$\left(\frac{N}{6}\right)th$$

switch group turn on while the other switches turn off in the $$\left(\frac{N}{6}\right)th$$

cycle of the switch controlling signal SC. At this moment, six data signals which are sent from the timing controller 20 and received by the data input channels $C_1$~$C_6$ are fed to the buffers $B_{N-5}$~$B_N$ of the $$\left(\frac{N}{6}\right)th$$

buffer group through the switches $SW_{N-5}$~$SW_N$ of the $$\left(\frac{N}{6}\right)th$$

switch group. After the N buffers $B_1$~$B_N$ receive the data signals, i.e. the data signals of subpixels $P_1$~$P_N$ in a row, the timing controller 20 controls the buffers $B_1$~$B_N$ conducting the digital signals to the subpixels $P_1$~$P_N$.

In the source driving module according to the present invention, each sub-module comprises less elements, thereby reducing costs. Take 960 subpixles in each row (i.e. N=960) as an example, the conventional source driving module, as shown in FIG. 1, includes 960 bi-directional shift registers $S/R_1$~$S/R_N$, 960 latches $L_1$~$L_N$, 960 level shifters $L/S_1$~$L/S_N$, 960 digital to analog converters $DAC_1$~$DAC_N$, and 960 buffers $B_1$~$B_N$. Rather, the present inventive source driving module, as shown in FIG. 2, comprises 6 level shifters $L/S_1$~$L/S_6$, 6 digital to analog converters $DAC_1$~$DAC_6$, 960 switches $SW_1$~$SW_{960}$, 960 buffers $B_1$~$B_{960}$, and a frequency divider 31. By contrast, the present inventive source driving module not only omits bi-directional shift registers and latches, but also reduces the number of level shifters and digital to analog converters. Although the present inventive source driving module adds more switches and a frequency divider, the number of required elements applied in each sub-module decrease. Therefore, the layout of the present inventive source driving module is simplified and reduces cost.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A liquid crystal display (LCD) panel comprising:

a display unit, comprising a plurality of subpixels, N subpixels being arranged in a row;

a timing controller;

a gate driving module, controlled by the timing controller to supply scan signal to the plurality of subpixels; and a source driving module, controlled by the timing controller to supply data signal to the plurality of subpixels, comprising:

n data input channels, receiving n data signals from the timing controller;

n level shifters, coupled to the n data input channels;

n digital to analog converters, coupled to the n level shifters;

N switches, divided into $$\frac{N}{n}$$

switch groups, each switch group coupled to the n digital to analog converters;

N buffers, divided into $$\frac{N}{n}$$

buffer groups, each buffer group coupled to one of the $$\frac{N}{n}$$

switch groups;

a frequency divider, for converting a clock signal sent from the timing controller into a switch controlling signal to alternatively switch on the $$\frac{N}{n}$$

switch groups;

wherein during a mth period of data transmission, the n data input channels receive data signals of n pixels from the timing controller, and the data signals of n pixels is fed to a mth buffer group via a mth switch group upon receiving the switch controlling signal, where N is an integer greater than 1, n is an even number, N>>n, $$\frac{N}{n}$$

is an integer greater than 1, and m=1, 2, 3, . . . , $$\frac{N}{n};$$

when receiving the data signals, the N buffers are controlled to transmit the data signals to the N subpixels by the timing controller.

2. The LCD panel of claim 1, wherein $2 \leq n \leq 10$.

3. The LCD panel of claim 1, wherein n=6.

4. The LCD panel of claim 1, wherein a period of data transmission and is several times of a duty cycle of the clock signal, and a duty cycle of the switching controlling signal equals to the period of data transmission, the period of data transmission indicates a period which each data input channel receive data signal of a pixel from the timing controller.

5. The LCD panel of claim 4, wherein each data input channel receive a 8-bit digital data signal during the period of data transmission.

6. The LCD panel of claim 5, wherein the period of data transmission comprises four duty cycles of the clock signal.

7. A source driving module for supplying data signals sent from a timing controller to a plurality of subpixels of a liquid crystal display panel, N subpixels being arranged in a row, the source driving module comprising:

n data input channels, receiving n data signals from the timing controller;

n level shifters, coupled to the n data input channels;

n digital to analog converters, coupled to the n level shifters;

N switches, divided into $$\frac{N}{n}$$

switch groups, each switch group coupled to the n digital to analog converters;

N buffers, divided into $$\frac{N}{n}$$

buffer groups, each buffer group coupled to one of the $$\frac{N}{n}$$

switch groups;

a frequency divider, for converting a clock signal sent from the timing controller into a switch controlling signal to alternatively switch on the $$\frac{N}{n}$$

switch groups;

wherein during a mth period of data transmission, the n data input channels receive data signals of n pixels from the timing controller, and the data signals of n pixels is fed to a mth buffer group via a mth switch group upon receiving the switch controlling signal, where N is an integer greater than 1, n is an even number, N>>n, $$\frac{N}{n}$$

is an integer greater than 1, and m=1, 2, 3, . . . , $$\frac{N}{n};$$

when receiving the data signals, the N buffers are controlled to transmit the data signals to the N subpixels by the timing controller.

8. The source driving module of claim 7, wherein $2 \leq n \leq 10$.

9. The source driving module of claim 7, wherein n=6.

10. The source driving module of claim 7, wherein a period of data transmission and is several times of a duty cycle of the clock signal, and a duty cycle of the switching controlling signal equals to the period of data transmission, the period of data transmission indicates a period which each data input channel receive data signal of a pixel from the timing controller.

11. The source driving module of claim 10, wherein each data input channel receive a 8-bit digital data signal during the period of data transmission.

12. The source driving module of claim 11, wherein the period of data transmission comprises four duty cycles of the clock signal.

* * * * *